United States Patent [19]

Baumgartner et al.

[11] 4,341,065

[45] Jul. 27, 1982

[54] PRODUCTION OF BINDINGS OF FIBER BUNDLES

[75] Inventors: August Baumgartner, Uster; Martin Plaschy, Zurich, both of Switzerland

[73] Assignee: Zellweger Uster Ltd., Uster, Switzerland

[21] Appl. No.: 271,261

[22] Filed: Jun. 8, 1981

[30] Foreign Application Priority Data

Jul. 23, 1980 [CH] Switzerland ..... 5612/80

[51] Int. Cl.[3] ..... B65H 69/06; D01H 15/00

[52] U.S. Cl. ..... 57/22; 57/202

[58] Field of Search ..... 57/22, 261, 202

[56] References Cited

U.S. PATENT DOCUMENTS

| | | | |
|---|---|---|---|
| 3,040,153 | 6/1962 | Seney | 57/22 |
| 3,307,339 | 3/1967 | Porter | 57/22 |
| 3,504,488 | 4/1970 | Illman | 57/22 |
| 3,668,852 | 6/1972 | Fusco et al. | 57/22 |
| 4,217,749 | 8/1980 | Rohner et al. | 57/22 X |

*Primary Examiner*—Donald Watkins

*Attorney, Agent, or Firm*—Craig and Antonelli

[57] ABSTRACT

This invention relates to a method and an apparatus for avoiding untwisting during the formation of a binding of two fiber bundles. The rotational direction of deformation members acting on the fiber bundles is selected to be different in different groups of deformation members in order to reproduce or to increase the original twist during the binding operation.

15 Claims, 23 Drawing Figures

PRODUCTION OF BINDINGS OF FIBER BUNDLES

FIELD OF THE INVENTION

This invention relates to the production of bindings for fiber bundles, primarily for use in the textile industry. Within the context of the present invention, the term "fiber bundles" is to be understood as designating a bundle of fibers, a yarn or a ply yarn, a twine or a rope or a similar stretched structure of combined fibers or threads, in which both vegetable and animal as well as synthetic base materials or mixtures of such may be included. In the broadest sense, the invention relates in particular to the field of the textile industry, but it is not restricted to this field.

BACKGROUND OF THE INVENTION

Copending U.S. application Ser. No. 149,545, filed May 13, 1980, describes the production of a binding for fiber bundles. This copending application describes a binding of fiber bundles which is produced by the effect of deformation members and in which fibers, originating from at least one of the fiber bundles to be bound, loop around the binding point in a force-locking manner. Very effective bindings of the type specified may be produced very rapidly by the method and apparatus described in that copending application. However, depending on the character of the fiber bundles to be bound, cases may arise in which a degree of untwisting, i.e. a loosening, results in a fiber bundle on one side of the binding due to the additional twist impressed on the fiber bundles during the formation of the binding on the other side of the binding.

Such untwisting occurs on one or on the other side of the completed binding, which is to be formed whether Z-twist or S-twist fiber bundles are involved. The natural elasticity of fiber bundles, together with an uneven gripping of the bundles to be bound as proposed according to the above-mentioned copending application is adequate for many fiber bundles for avoiding a disadvantageous influence by the additional twist mentioned. In these cases, a balance in the twist is produced from a neighboring zone of the untwisted fiber bundles.

This does not always happen to a sufficient extent with other fiber bundles, in particular, those which are relatively flexible or are loosely twisted. The result of this is that the binding produced does have an adequate strength, but the tensile strength in the untwisted region mentioned, i.e. next to one end of the binding, is undesirably reduced.

BRIEF DESCRIPTION OF THE INVENTION

An object of this invention is to overcome this disadvantage and to ensure in particular that a disturbing untwisting action does not occur in the fiber bundles which have been bound.

According to this invention, there is provided a method for the production of a binding for fiber bundles in which the fiber bundles to be bound together are brought into at least approximately-parallel, closely-neighboring position to each other, then shearing forces and tractive and/or compressive forces are exerted at least on a part of the circumference of each of the fiber bundles to be bound and on all of the fiber bundles by physical contact of the same using moving deformation members, in order, on the one hand, to change the original cross sections and/or the original structure of the fiber bundles to be bound, and on the other hand, to at least partly release individual fibers from their bundle from at least one of the fiber bundles to be bound and to displace them such that they finally wind around the fiber bundles to be bound in a force-locking manner at least in one part of the operational region of the deformation members. The fiber bundles bound by the winding are then relocated out of the operational region of the deformation members. The invention is characterized in that the direction of forces acting on the fiber bundles is selected variably in different sections in the longitudinal direction of the binding to be produced.

BRIEF DESCRIPTION OF THE DRAWINGS

The invention will now be described by way of example with reference to the accompanying drawings, in which.

Corresponding parts are given the same reference numbers in all of the figures, which, for reasons of clarity, are not drawn to scale.

DETAILED DESCRIPTION OF THE PREFERRED EMBODIMENTS

Figure 1:
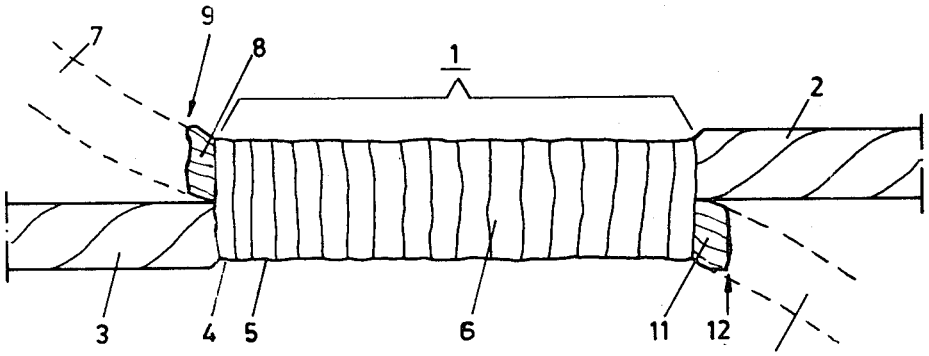
FIG. 1 is a schematic illustration of a binding as it may be produced according to the aforesaid copending application.

FIG. 1 schematically illustrates a binding as it may be produced as described in the above-mentioned copending U.S. application Ser. No. 149,545. In this illustration, two fiber bundles 2 and 3 are wound around and compressed in a substantially force-locking manner in the region of a binding 1 by many fibers 4, 5, 6, etc. Reference is made explicitly to the said copending application concerning the different structures of bindings which may be produced and the configuration of the deformation members available. It will only be mentioned here that the individual fibers of the different fiber bundles may be mixed together in various ways in the completed binding 1 as is typically illustrated in FIGS. 3 to 6 in the above-referenced copending application.

Figure 3:
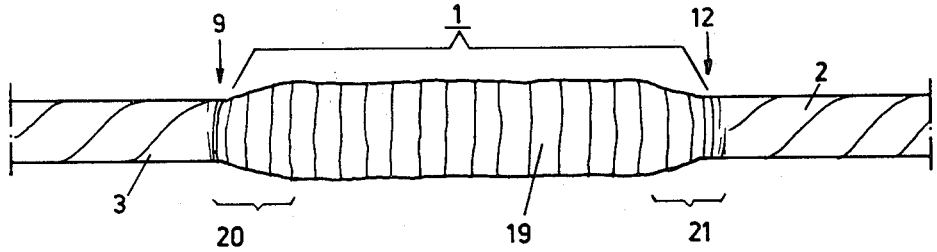
FIG. 3 illustrates a binding of the type specified, in which a part of the loose ends is severed and the bound ends are introduced or worked into the binding.

FIG. 1 of the present application also shows that after the binding 1 has been completed, the loose ends 7 and 10 of the fiber bundles 2 and 3 bound by the binding 1 have to be severed at the points 9 and 12, as a result of which, stumps 8 and 11 are produced. These stumps may hinder the further processing of the bound fiber bundles which is why it may be appropriate to remove the loose ends 7 and 10 which are initially present by a fraying severing in the end regions 13 and 14, at the points 15 and 16 during the formation of the binding, for example, by guiding them away over an abrasive edge, in the manner disclosed in my copending U.S. application Ser. No. 271,262, filed June 8, 1981, in the name of August Baumgartner. The frayed bound ends 17 and 18 which result from this operation may be worked or introduced in the end regions 20 and 21 into the resulting binding 1, or into the winding 19 thereof, while the binding 1 is being produced, to produce a binding as seen in FIG. 3.

Figure 4:
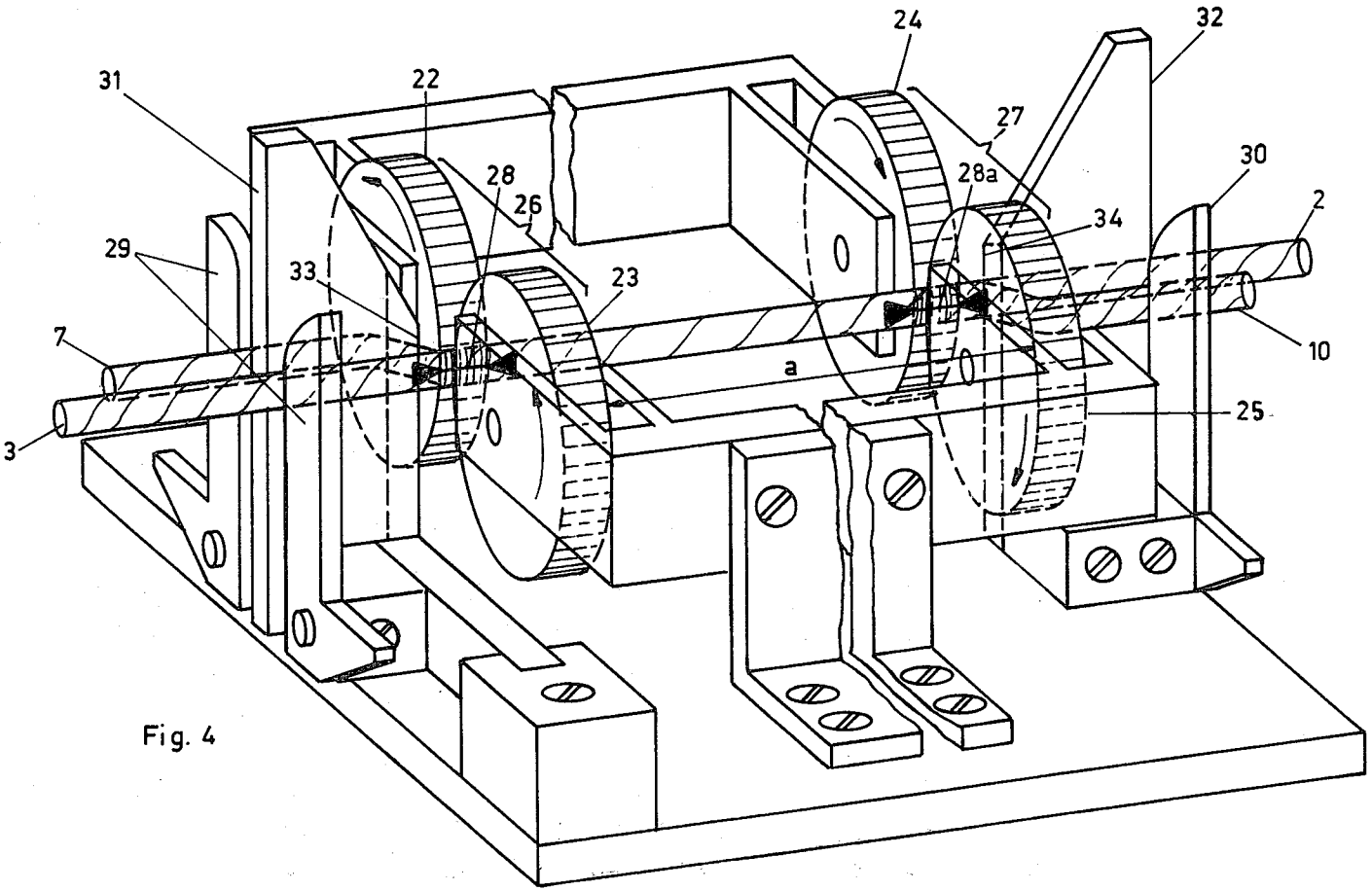
FIG. 4 is a schematic perspective view of an apparatus for carrying out the method of the present invention.

FIG. 4 schematically illustrates an apparatus for binding fiber articles and, in particular, illustrates measures in accordance with this invention for avoiding untwisting on one side of the binding 1 of the two fiber bundles 2 and 3. In contrast to the embodiment of FIG. 8 of the said copending U.S. application Ser. No. 149,545, the apparatus of FIG. 4 of the accompanying drawings is an arrangement in which pairs of deformation members 22 and 23, or 24 and 25, respectively, are combined to form two longitudinally-spaced deformation groups 26 and 27, respectively. It may be seen in FIG. 4 that these two deformation groups 26 and 27 act to exert forces on the fiber bundles 2 and 3 to be bound, in different sections 28 and 28*a* spaced along the fiber bundles in the longitudinal direction.

FIG. 4 also illustrates that the two fiber bundles to be bound are temporarily held by guide means 29 and 30, for example, by a clamping effect, and may then be brought into an operational region by a relative movement between the guide means 29 and 30 and the deformation groups 26 and 27, and they may also be removed therefrom in a similar way. Such relative movement may be effected in any known way, such as by providing for upward and downward sliding movement of the guide means 29 and 30 in their supports, or by effecting movement of the supports for the deformation members. During this operation, the relative movement is directed transversely to the axes of the deformation groups and also transversely to the longitudinal direction of the fiber bundles to be bound.

In FIG. 4 the spacing a between the two deformation groups 26 and 27 is not drawn to scale, because the purpose of FIG. 4 is primarily to explain the principle of the invention. It should be noted, however, that the deformation members 22, 23 of the deformation group 26 rotate in a direction opposite to the direction of rotation of the deformation members 24, 25 of the deformation group 27. As a result of this contrary movement, an additional twist is imparted to the fiber bundles 2 and 3 to be bound since the rotation applied in section 28 is opposite to the rotation applied in section 28*a* (see FIG. 4). In this operation, the appropriate direction of rotation of the deformation members 22 and 23, as well as 24 and 25, is selected in accordance with the original twist of the fiber bundles 2 and 3 to be bound, i.e., it is dependent on whether they are Z-twist or S-twist fiber bundles.

Other deformation members and/or guide members may preferably be positioned in the interspace a between the deformation groups 26 and 27, as will be explained later on with respect to other embodiments.

Figure 2:
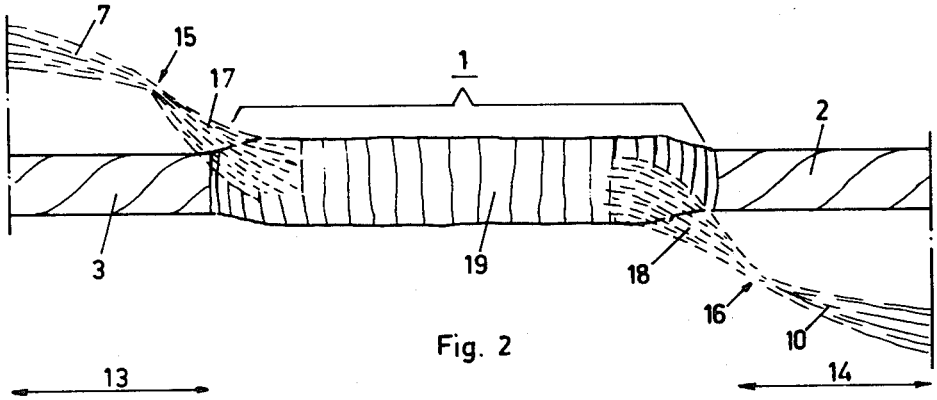
FIG. 2 illustrates an intermediate stage during the production of a binding, in which loose ends are removed.

With respect to FIG. 4, it is also noted that the two fiber ends to be bound are introduced into the apparatus on one side in a correct, approximately-parallel position by severing elements 31 or 32 on both sides of the apparatus, the loose ends 7 and 10 (see FIG. 1) being also guided away around an edge 33 or 34 by the severing elements 31 and 32 in order to produce a severing of these loose ends according to FIGS. 2 and 3. Moreover, the edges 33 and 34 deflect the loose ends 7 and 10 around an edge of the surfaces of the deformation members 22 and 25 which has an abrasive effect. This promotes the fraying severing of the loose ends and also assists the introduction or working-in operation of the remaining bound ends 17 and 18 into the resulting binding 1.

The apparatus of FIG. 4 is mounted on a base plate. For reasons of clarity, the drive mechanism for the deformation members is not illustrated in FIG. 4.

Figure 5:
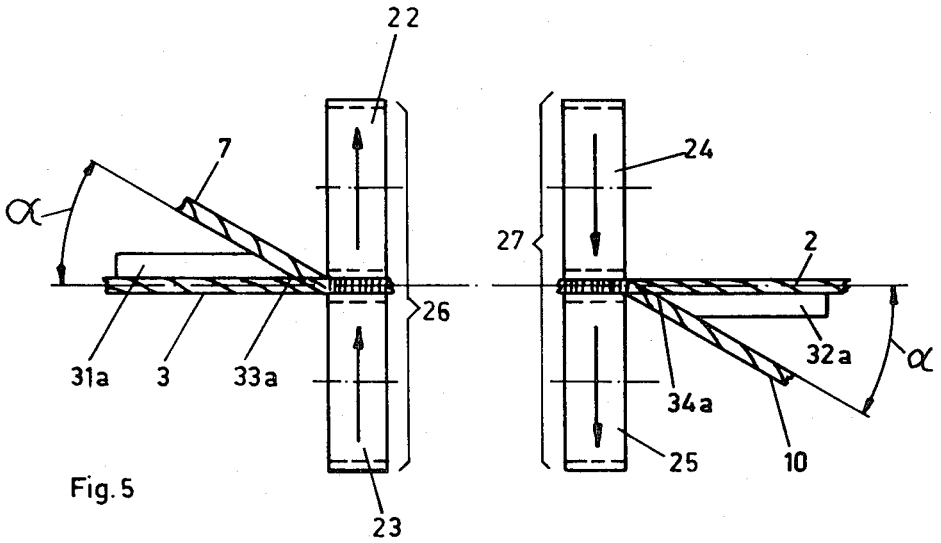
FIG. 5 is a schematic view of a modification of the apparatus illustrated in FIG. 4.

FIG. 5 schematically illustrates how a severing element 31*a* or 32*a* may also be positioned in the longitudinal direction of the fiber bundles 2 and 3 instead of transversely (as in FIG. 4) in order to deflect the loose ends 7 and 10 at the angle $\alpha$. As a result of this, the loose ends 7 and 10 are guided around the edges 33*a* or 34*a* in order to sever them.

Figure 6:
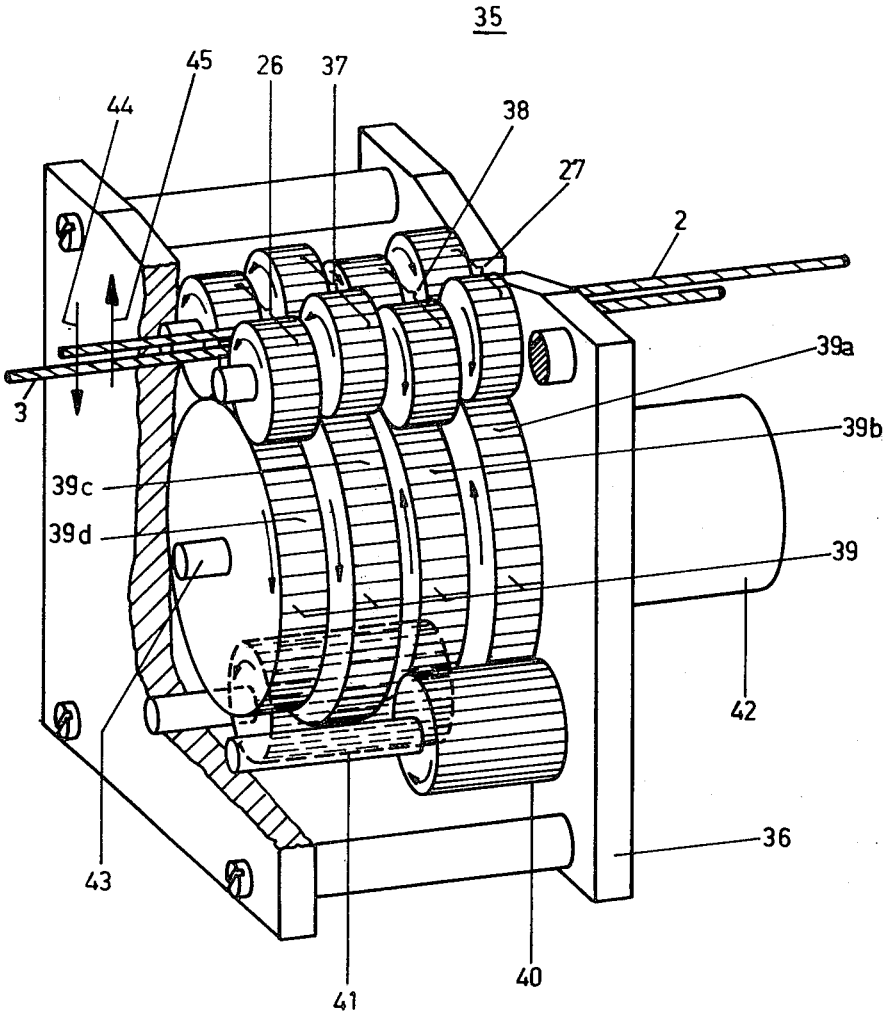
FIG. 6 illustrates details of another embodiment.

FIG. 6 illustrates a detail of another embodiment of this invention. The guide means 29 and 30 and the severing elements 31 and 32 indicated in FIG. 4, which form part of the combination, are not illustrated in FIG. 6 in order not to complicate the drawing. The two deformation groups 26 and 27, and in addition thereto, two additional deformation groups 37 and 38, are mounted in a frame 36. All of these deformation groups are rotatable during the production of the binding in the directions indicated by arrows by means of respective intermediate gear 39.

It will again be seen that, as in the FIG. 4 construction, the outermost deformation groups 26 and 27 rotate in opposite directions. In the FIG. 6 construction, the two other deformation groups 37 and 38 are positioned between the deformation groups 26 and 27. It also should be noted that the deformation group 37 which is next to the lefthand deformation group 26 rotates in the same direction as this deformation group 26. Likewise, the inside deformation group 38 next to the right-hand deformation group 27 rotates in the same direction as the deformation group 27. Thus, the rotational direction of the two lefthand deformation groups 26 and 37 is opposite to the rotational direction of the two right-hand deformation groups 38 and 27.

Figure 6A:
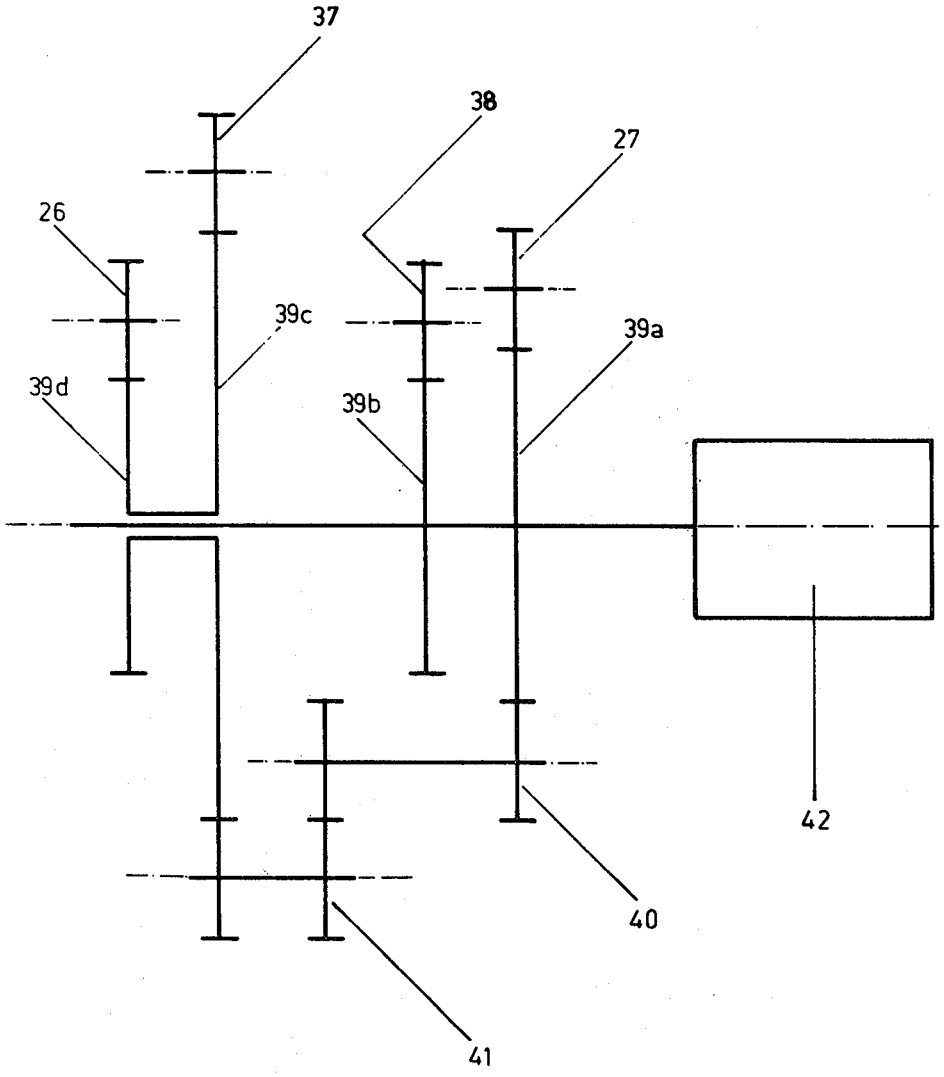
FIG. 6*a* schematically illustrates the operation and the meshing of toothed wheels.

FIG. 6*a* schematically illustrates the operation of the meshing of the deformation members or the toothed wheels illustrated in FIG. 6. A driving motor 42 directly drives the gears 39*a* and 39*b* via drive shaft 43. Further gears 39*c* and 39*d* are connected together in angularly-fixed positions, but they rest loosely on the same shaft 43 as the gears 39*a* and 39*b*.

The gear 39*a* meshes with a pinion 40. The pinion 40 meshes with the other pinion 41. The pinion 41 meshes with the gear 39*c*. The diameters of the gears 39*b* and 39*d* are smaller than the diameters of the gears 39*a* and 39*c*.

The deformation group 26 meshes with the gear 39*d*. The deformation group 27 meshes with the gear 39*a*. The deformation group 37 meshes with the gear 39*c*. The deformation group 38 meshes with the gear 39*b*.

The axes of the deformation groups 26 and 38 are in the same plane. (See FIG. 6). The axes of the deformation groups 37 and 27 are also in the same plane. However, it should be noted that the axes of the deformation groups 37 and 27 are higher than that of the deformation groups 26 and 38. Due to this staggered arrangement of the deformation groups, a staggering in time of the influencing intervals on the fiber bundles 2 and 3 is achieved when they are introduced in the direction of arrow 44 or removed in direction of arrow 45 (see FIG. 6).

With the invention, the tendency of the deformation members is to reproduce or increase the twist originally contained in the fiber bundles to be bound on one side of the resulting binding 1 because the two outermost deformation groups 26 and 27 rotate in opposite directions and therefore exert their forces on the fiber bundles 2 and 3 to be bound in different directions. In this regard, as shown in FIG. 6, the operational regions between the deformation members of the deformation group 26 and the deformation group 38 on one side and the operational regions of the deformation members of the deformation groups 37 and 27 on the other side are at different heights.

Due to the fact that the fiber bundles 2 and 3 to be bound are introduced into the apparatus 35 in the direction of the arrow 44 and are then removed from the apparatus in the direction of the arrow 45, i.e., they are temporarily brought into the operational regions in a direction transverse to the longitudinal direction of the fiber bundles or of the axes of the deformation members, and due to the fact that these operational regions are staggered, the deformation members become effective at different time intervals in the individual groups and therefore in the individual sections along the fiber bundles. These time intervals may be selected either with or without an overlap, depending on the assumed staggering of the axes. Therefore, forces act in different directions at different positions along the fiber bundles to be bound and at different time intervals.

As a result of the combined effect which is produced from the above-described operation, the untwisting which would otherwise have occurred is effectively overcome.

Where there is a sufficiently-close arrangement of the deformation groups 26, 37, 38 and 27, the partial bindings resulting in the operational regions thereof merge together practically constantly and form a complete binding 1. It is now certain that the twist which was originally present is reproduced on both sides of the complete binding 1, in the fiber bundles 2 and 3 being guided away. In certain cases, a slightly-increased twist may even be produced. Therefore, in the binding of two fiber bundles 2 and 3 in the previously-described manner, the risk of the production of weak points outside the complete binding 1 is effectively removed.

An apparatus 35 according to FIG. 6 may, of course, be provided with additional devices for severing the loose ends, as in the FIG. 4 construction, and it therefore produces a complete binding 1 without projecting loose ends, but with ends 17 and 18 which are neatly introduced or worked into the complete binding 1, so that the complete binding finally appears similar to that illustrated in FIG. 3, whereby the total length of the binding may possibly be selected to be slightly longer corresponding to the larger number of deformation members.

Figure 7:
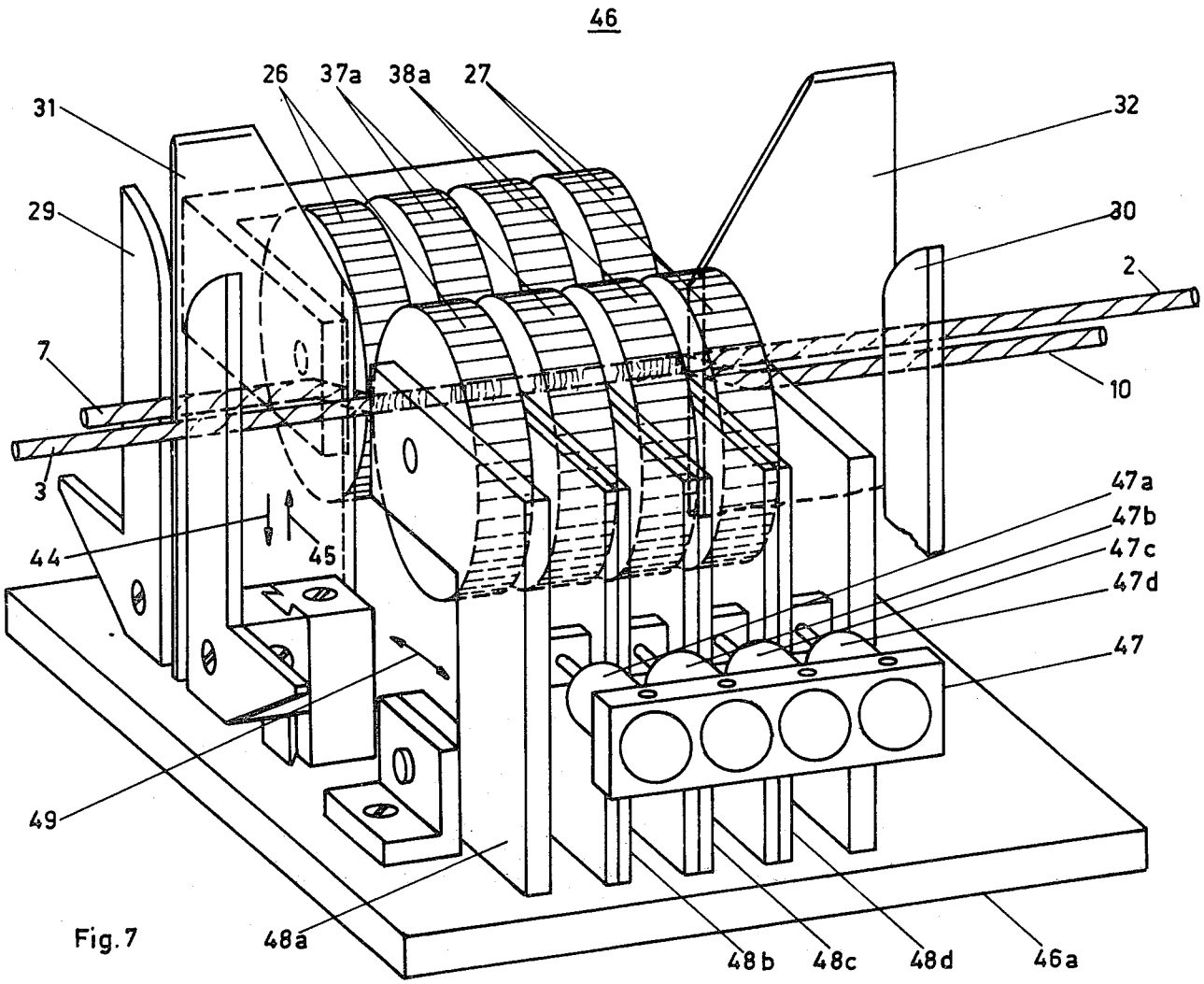
FIG. 7 illustrates another embodiment.

FIG. 7 illustrates another apparatus 46, in which the guide means 29 and 30 on one side may be moved in the direction of the arrows 44 and 45 on a base plate **46*a* by sliding movement on their supports as already indicated with respect to the embodiment of FIG. 4. In this apparatus 46, a total of four deformation groups 26, 37*a*, 38*a* and 27 is provided. However, in contrast to the embodiment according to FIG. 6, the axes of the deformation groups are all in the same plane. In order that not all the deformation members mesh simultaneously or not all the deformation members act simultaneously on the fiber bundles 2 and 3 due to the drive of the deformation members, which is not illustrated for reasons of clarity, the apparatus 46 has a control device 47. Due to such a control device 47, the front deformation members of the deformation groups 26, 37*a*, 38*a* and 27, which are mounted on pivot members 48*a*, 48*b*, 48*c* and 48*d*, may be moved towards the rotatable but not pivotable rear deformation members of the deformation groups mentioned, for example, by means of four individually-connectable electromagnets 47*a*, 47*b*, 47*c* and 47*d*. During this operation, the pivot region may be restricted in the direction of the double-headed arrow 49 by stops, which are not illustrated in FIG. 7**.

Figure 8:
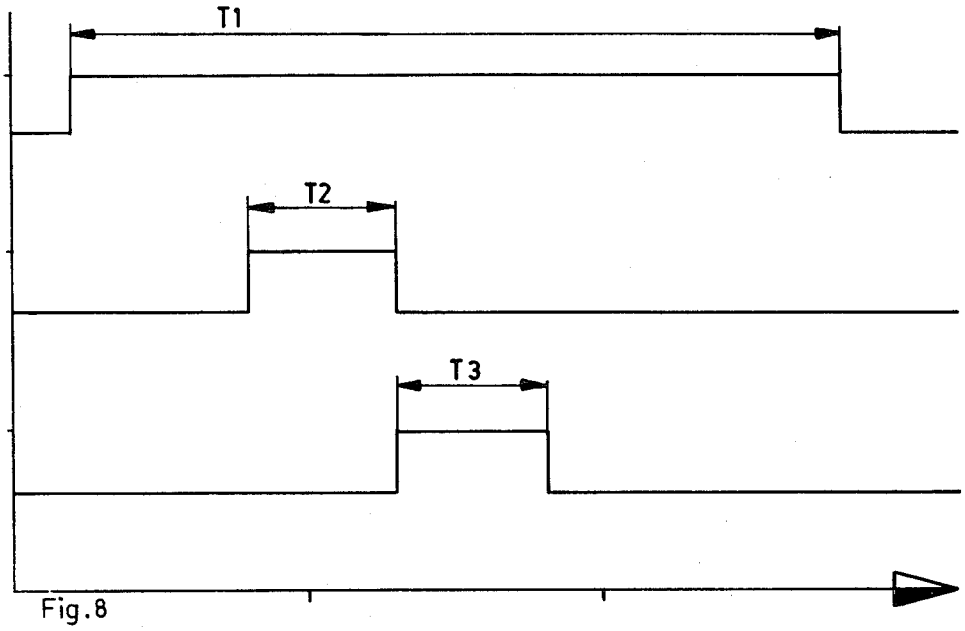
FIGS. 8, 9 and 9*a* illustrate examples of pulse programs.
Figure 9:
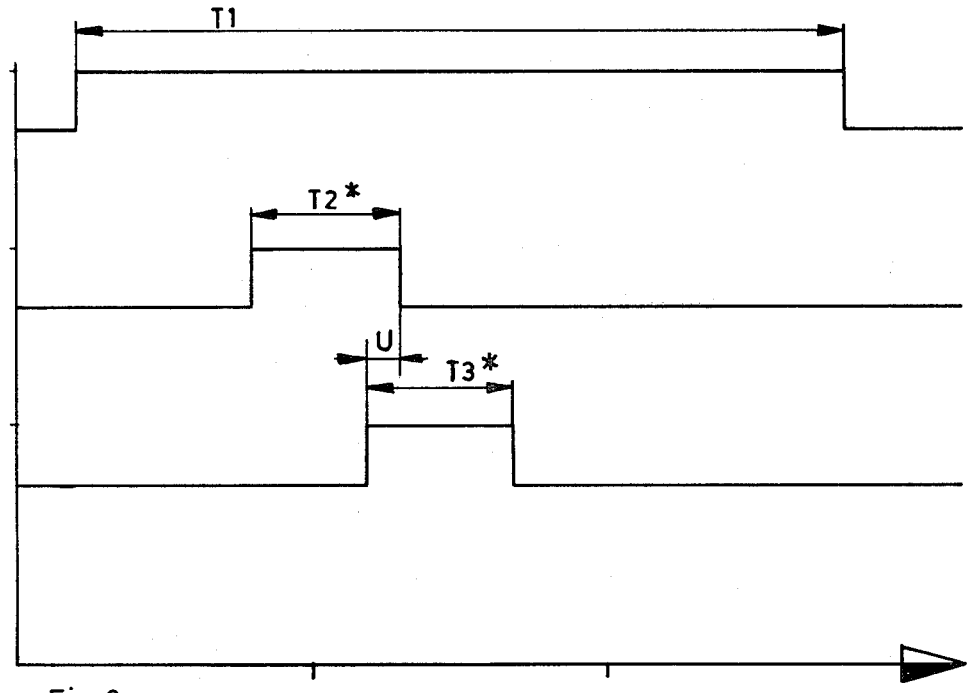
Figure 9A:
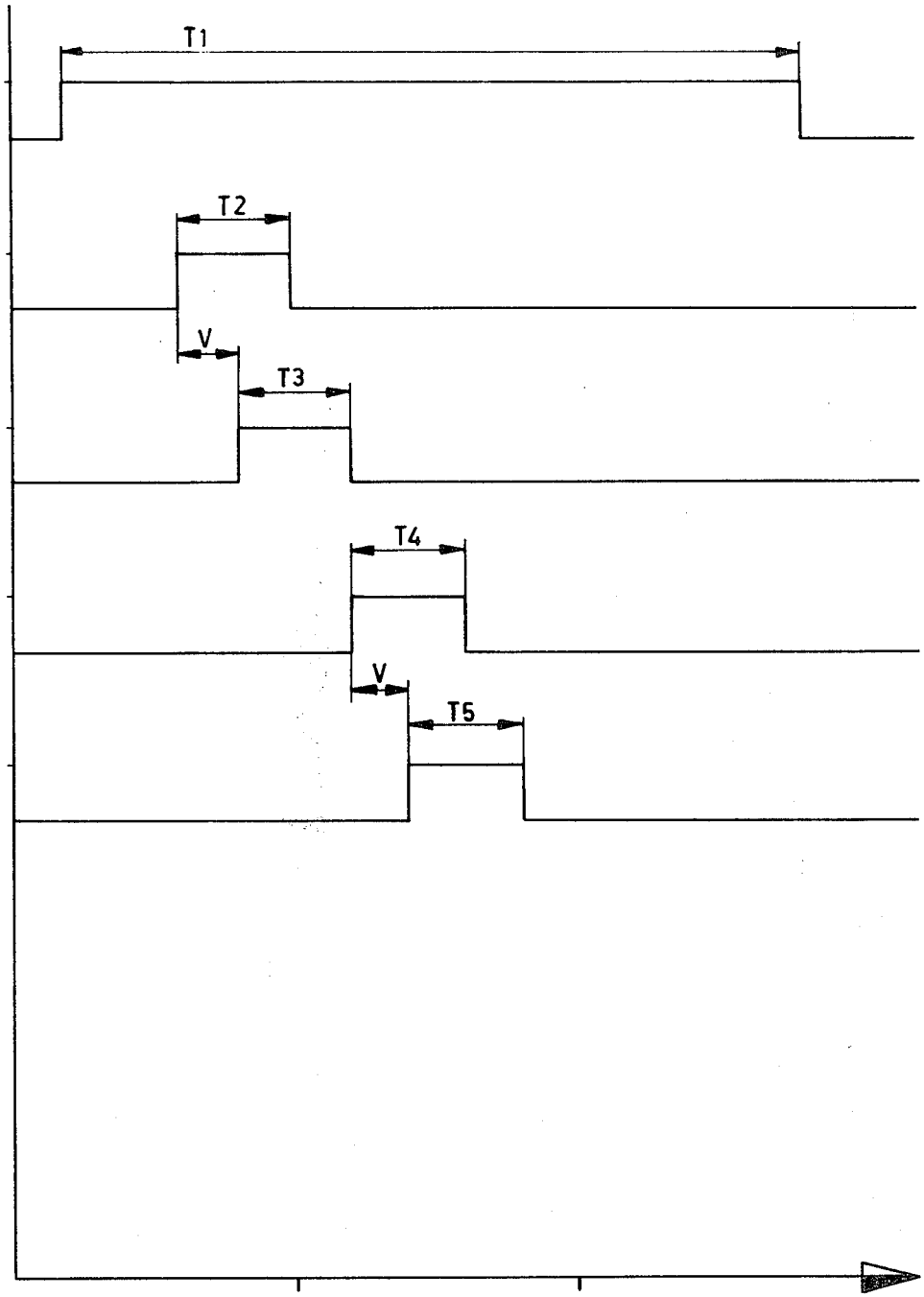

The movement of the individual groups 26, **37*a*, 38*a* and 27 may be staggered in time. In this operation, the actuation of the individual electromagnets may be produced in a manner known per se by a corresponding pulse program. Examples of such pulse programs are illustrated in FIGS. 8, 9 and 9*a*. As shown in FIG. 8, the driving motor (not shown) for the deformation members is switched on during the complete period of time T1, while the electromagnets 47*a* and 47*c* are switched on during the period of time T2 and the electromagnets 47*b* and 47*d* are switched on during the period of time T3**.

Similarly, as shown in FIG. 9, the connection of the abovementioned magnets may be effected with a time overlap, as is indicated in the specified intervals T2* and T3* by the overlap U.

With the staggered operation of the deformation members, the connections according to FIG. **9*a* are effected as follows: During the period of time T1, the deformation members are driven and the electromagnet 47*a* is energized during the period of time T2. The electromagnet 47*c* is energized during the time interval T3 with a time delay V. Subsequent to the period of time T3, the electromagnet 47*b* is energized during the period of time T5 from the start of the period of time T4** with a time delay V.

Where there is such a control of the operational times of the individual deformation groups, a complete binding 1 composed of several partial bindings may be produced between the fiber bundles 2 and 3, whereby the untwisting mentioned is effectively avoided due to the different rotational direction between the first deformation group 26 and the last deformation group 27.

In an apparatus according to FIG. 7, the pivot members **48*a*, 48*b* and 48*d*** preferably extend just up to the immediate vicinity of the fiber bundles and therefore also act as a guide for these fiber bundles in the interspaces between the deformation groups or immediately next to them. Such a guiding of the fiber bundles at the points mentioned may substantially promote the formation of a continuous binding.

Moreover, it is advantageous to restrict the pivot region of the pivot members, which is denoted in FIG. 7 with a double-headed arrow 49, by adjustable stops, as a result of which the width of the operational region may be established in a definite manner. This measure is advantageous in order to achieve regular results.

The temporal course of the formation of yarn bindings using apparatus of the type described in FIGS. 6 and 7 will now be described in detail with reference to FIGS. 10 through 13.

Figure 10:
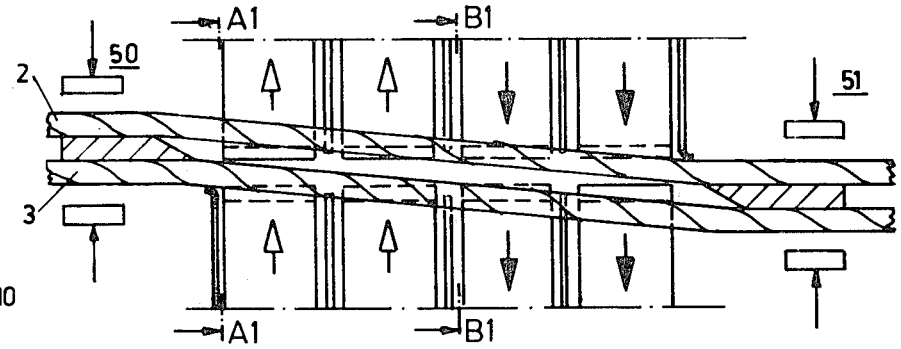
FIG. 10 schematically illustrates an arrangement involving four deformation groups.

FIG. 10 schematically illustrates an arrangement involving four deformation groups which have deformation members movable in the directions indicated by the arrows. FIG. 10 illustrates the course of the fiber bundles 2 and 3 when they are inserted into the apparatus, while clamping devices 50 and 51 are still open on both sides of the deformation groups.

Subsequently thereto, clamping devices 50 and 51 are closed according to FIG. 11 and the yarn bundles are brought into the operational region of the deformation groups. In this operation, the deformation groups are controlled so that first of all the deformation members of the second and fourth deformation group are operational and therefore a partial binding 52 or 53 is each produced in the operational regions thereof. Guide members 58*a* guide the fiber bundles.

Figure 12:
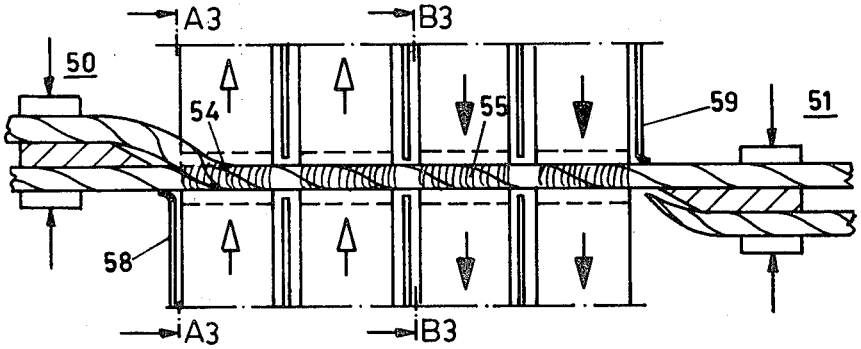

In a further phase according to FIG. 12, the deformation members of the first and third deformation group are now operational, so that partial bindings 54 and 55 are also produced in the operational regions thereof. As a result of this operation, a total of four partial bindings is produced which merge together in practice where the arrangement is of an adequately-narrow design, so that finally, a complete binding is produced, the length of which approximately corresponds to the length of the complete arrangement of deformation members.

Figure 11:
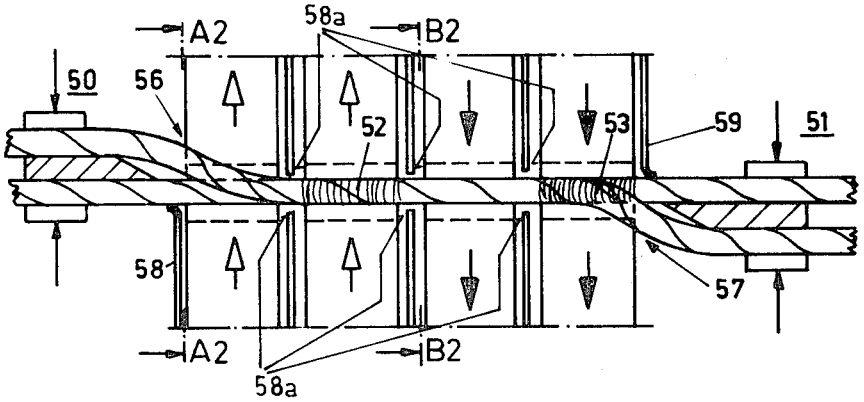
FIGS. 11, 12 and 13 illustrate different conditions during the construction of the binding.
Figure 13:
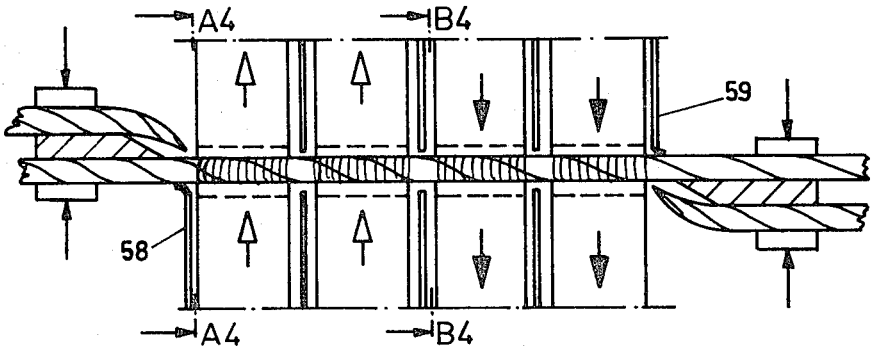

It may be seen from FIGS. 11 and 12 that at the points 56 and 57, i.e., at the external edges of the outermost deformation members, one each of the deformation members exerts an abrasive effect on a free end of the fiber bundles 2 and 3. As a result of this, as is illustrated in FIGS. 12 and 13, both the free end of the fiber bundle 2 as well as the free end of fiber bundle 3 fray. Due to guide elements 58 and 59 next to the outermost deformation groups, the severing of the loose ends and the formation of a continuous transition between the binding itself and the adjoining piece of the respective fiber bundle may be promoted.

Figure 10A:
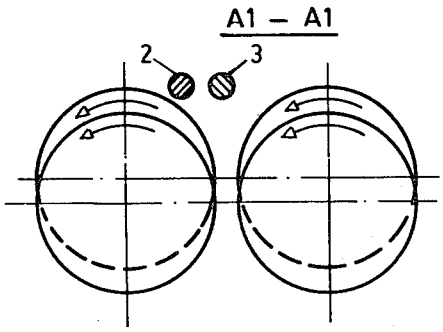
FIGS. 10*a*, 10*b*, 11*a*, 11*b*, 12*a*, 12*b*, 13*a* and 13*b* illustrate the relative positions of the fiber bundles and the directions of rotation.
Figure 10B:
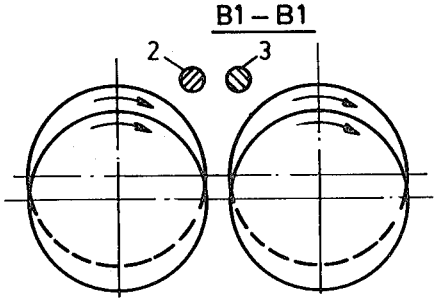

FIGS. 10*a* and 10*b* illustrate the relative positions of the fiber bundles and the rotational directions of the individual deformation members according to the arrangement in FIG. 10.

Figure 11A:
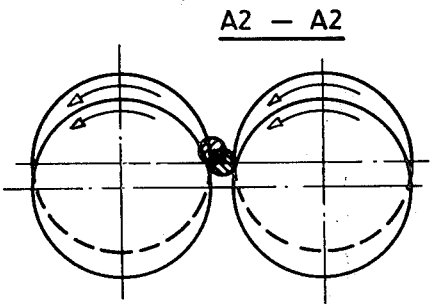
Figure 11B:
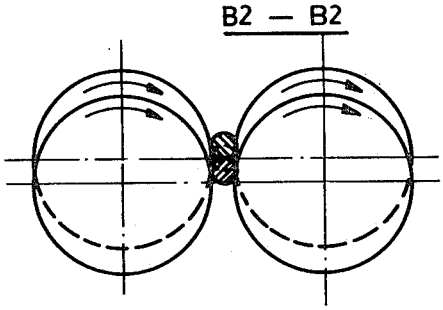

FIGS. 11*a* and 11*b* illustrate the relative positions of the fiber bundles and the rotational directions of the respective deformation members according to the situation in FIG. 11.

Figure 12A:
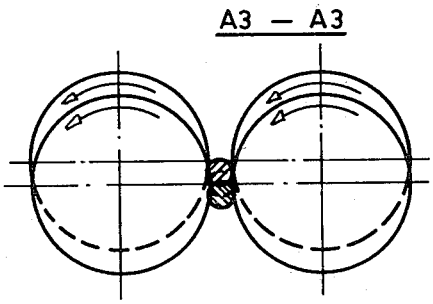
Figure 12B:
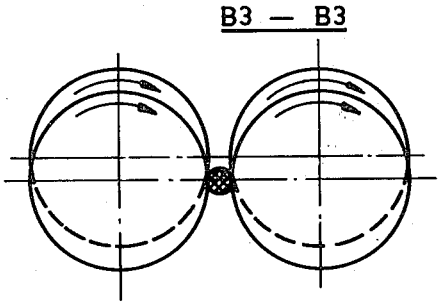

FIGS. 12*a* and 12*b* illustrate the relative positions of the fiber bundles and the rotational directions of the deformation members corresponding to the situation illustrated in FIG. 12.

Figure 13A:
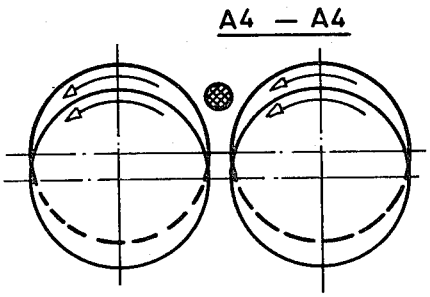
Figure 13B:
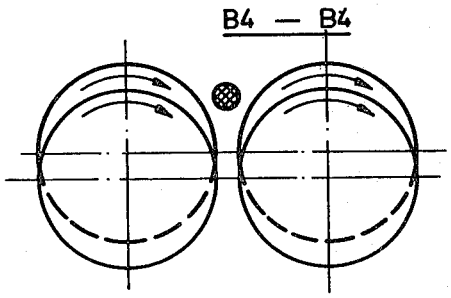

FIGS. 13*a* and 13*b* illustrate the position of the fiber bundles 2 and 3 which have been bound together and the relative rotational directions of the deformation members corresponding to the situation illustrated in FIG. 13.

While we have shown and described several embodiments in accordance with the present invention, it is understood that the same is not limited thereto but is susceptible of numerous changes and modifications as known to a person skilled in the art, and we therefore, do not wish to be limited to the details shown and described herein but intend to cover all such changes and modifications obvious to one of ordinary skill in the art.

What is claimed is:

1. A method for the production of a binding for twisted fiber bundles, comprising positioning the fiber bundles to be bound together in at least approximately-parallel, closely-neighboring position to each other; applying shearing forces and tractive and/or compressive forces to at least a part of the circumference of each of the fiber bundles to be bound and on all of the fiber bundles by effecting physical contact between the same with the use of opposed moving deformation members, in order, on one hand, to change the original cross sections and/or the original structure of the fiber bundles to be bound, and, on the other hand, to at least partly release individual fibers from at least one of the fiber bundles to be bound and to displace them such that they finally wind around the fiber bundles to be bound in a force-locking manner at least in on part of the operational region of the deformation members; and then relocating the fiber bundles bound by the winding out of the operational region of the deformation members, characterized in that the forces are applied to the fiber bundles during binding in directions which are selected variably in different sections in the longitudinal direction of the binding to be produced.

2. A method according to claim 1, characterized in that the forces on one portion of the fiber bundles and the forces on another portion of the fiber bundles to be bound are staggered in time.

3. A method according to claim 1 or 2, characterized in that the directions of the forces in the first and last sections, as seen in the longitudinal direction of the resulting binding, are substantially opposed.

4. A method according to claim 3, characterized in that the directions of the forces as applied variably to said fiber bundles are selected in the sense of an increase and/or a reproduction of the original twist of the fiber bundles.

5. A method according to claims 1 or 2, characterized in that forces are selectively applied to more than two sections of said fiber bundles with different sections, whereby the directions of application of the forces change from section to section in one part of all the sections and are identical in another part of all the sections.

6. A method according to claims 1 or 2, characterized in that a complete binding of the fiber bundles to be bound is composed of partial bindings at least partly formed in intervals staggered in time, in sections along the fiber bundles to be bound.

7. An apparatus for producing a binding from a plurality of twisted fiber bundles comprising at least two pairs of opposed deformation members which are movably mounted on longitudinally-spaced portions on a support; and drive means for moving the deformation members of each pair relative to each other in an operational region located therebetween so as to engage the fiber bundles to be bound, each deformation pair being allocated to one section in the longitudinal direction of the binding to be produced and including means for moving the deformation members of one pair in a direction different from that of the other pair whereby the forces in different deformation pairs exerted by the deformation members on the fiber bundles which are to be bound have different directions due to the different direction of movement of the deformation members, wherein said deformation members of each pair are rotatable bodies mounted for rotation with the circumferential surfaces opposed to each other, said drive means rotating the deformation members of each pair in the same direction and the deformation members of one pair in a direction opposite that of the other pair.

8. An apparatus according to claim 7, including more than two longitudinally-spaced pairs of opposed deformation members.

9. An apparatus according to claims 7 or 8, characterized in that guide members are provided adjacent to the deformation pairs to guide the fiber bundles along a given path which extends through the operational regions of the deformation pairs.

10. An apparatus according to claim 10, further including control means for controlling the engagement of said individual deformation members with said fiber bundles to be bound according to a time program in succession and/or alternating in time.

11. An apparatus according to claim 10, characterized in that said control means provides for the time intervals of the influence of the forces exerted by the deformation members on the fiber bundles to take place in one direction and in another direction with a time overlap.

12. An apparatus according to claim 10, characterized in that said control means provides for the time intervals of the influence of the forces exerted by the deformation members thereof on the fiber bundles to take place in one direction and in another direction without a time overlap.

13. An apparatus according to claim 9, characterized in that deformation pairs having different directions of movement of their deformation members are positioned in mutually-spatially staggered locations with respect to said given path such that during the formation of the binding, they engage with the fiber bundles to be bound at staggered times.

14. An apparatus according to claim 9, characterized in that the width of the operational region of at least one deformation pair is adjustable.

15. An apparatus according to claim 14, characterized in that the width of the operational region may be adjusted by a movable and adjustable mounting of at least one each of the deformation members of the adjustable deformation pair.

* * * * *